US005236513A

United States Patent [19]

Klein et al.

[11] Patent Number: 5,236,513

[45] Date of Patent: Aug. 17, 1993

[54] PROCESS FOR SUCKING OUT AND DRYING THE CAVITIES OF COATED MICROTITER PLATES

[75] Inventors: Heinz-Dieter Klein, Hofheim am Taunus; Bernhard Giesendorf, Marburg, both of Fed. Rep. of Germany

[73] Assignee: Hoechst Aktiengesellschaft, Frankfurt am Main, Fed. Rep. of Germany

[21] Appl. No.: 769,712

[22] Filed: Oct. 2, 1991

[30] Foreign Application Priority Data

Oct. 5, 1990 [DE] Fed. Rep. of Germany ..... 4031500

[51] Int. Cl.[5] ..... B08B 5/04

[52] U.S. Cl. ..... 134/21; 134/22.11; 134/22.12; 134/22.1

[58] Field of Search ..... 134/21, 21.1, 22.11, 134/22.12; 435/68

[56] References Cited

U.S. PATENT DOCUMENTS 4,496,657 1/1985 Coppersmith et al. ..... 435/287
4,703,003 10/1987 Struck ..... 435/68

OTHER PUBLICATIONS

European Patent Application 0367468 Sep. 5, 1990 Sinor, Lyle T.

*Primary Examiner*—Theodore Morris
*Assistant Examiner*—Edward Squillante
*Attorney, Agent, or Firm*—Finnegan, Henderson, Farabow, Garrett & Dunner

[57] ABSTRACT

In a process for sucking out and drying the cavities of coated microtiter plates, a cannula having an internal diameter of 0.5 to 3 mm is lowered into the cavity at a speed of 0.5 to 20 mm/second, and the cavity is emptied via the cannula with a suction capacity of 50 to 2500 1/hour. The cannula is stopped 0.05 to 3 mm above the cavity base.

2 Claims, 1 Drawing Sheet

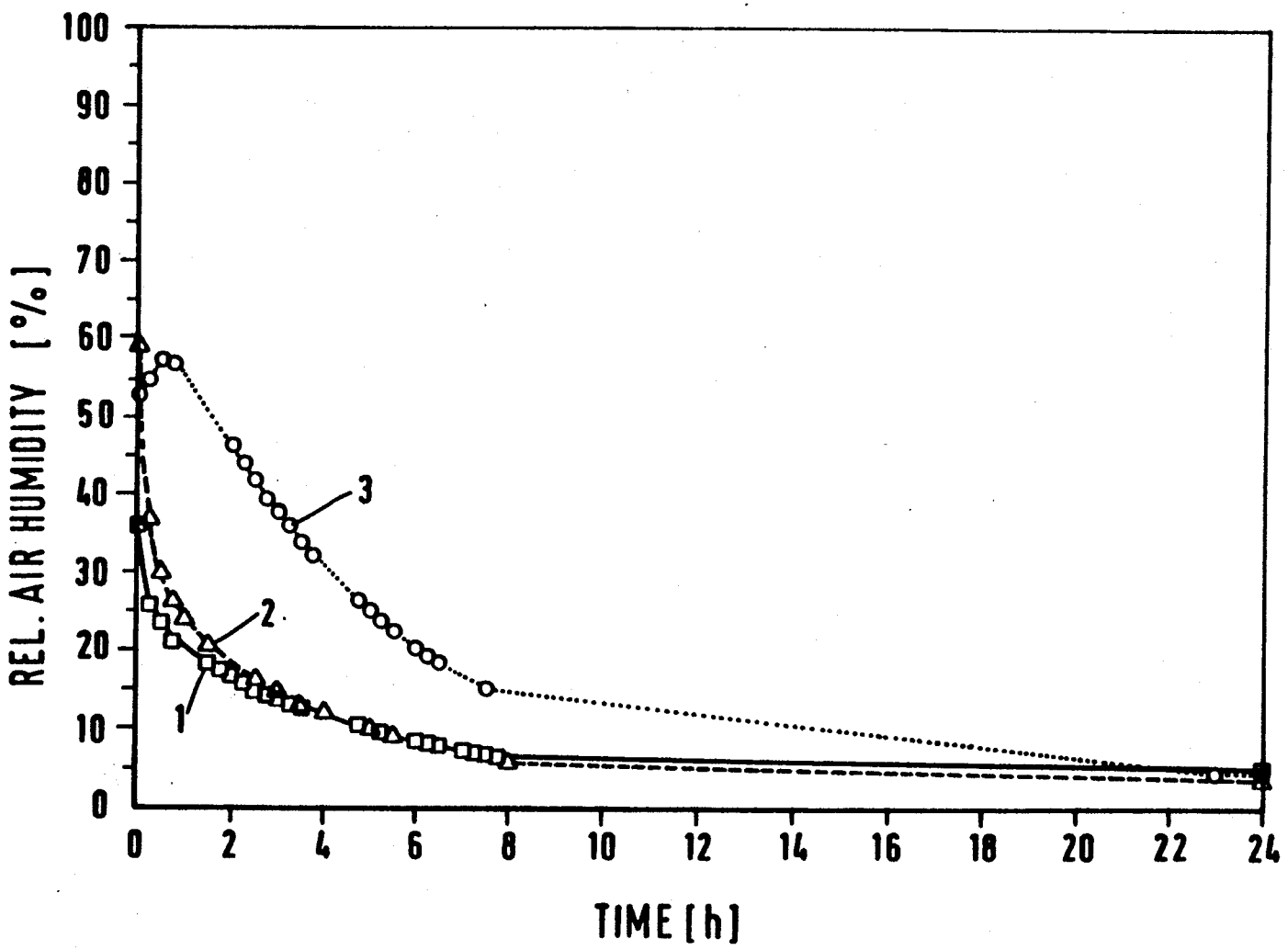
REL. AIR HUMIDITY [%]
100
90
80
70
60
50
40
30
20
10
0
TIME [h]
0
2
4
6
8
10
12
14
16
18
20
22
24
1
2
3

PROCESS FOR SUCKING OUT AND DRYING THE CAVITIES OF COATED MICROTITER PLATES

BACKGROUND OF THE INVENTION

1. Field of the Invention

The invention relates to a process for sucking out and drying the cavities of coated microtiter plates.

2. Description of the Related Art

Non-bonded or non-specifically bonded reagents on coated microtiter plates are removed by washing with buffer solutions which sometimes contain detergents. The wash liquids are removed via suction heads, and the titer plates are dried by means of a turbo dryer in a second step. In this procedure, turbulent compressed air flows into the cavity via a jet. The highly turbulent droplets are sucked up with a cannula. The disadvantages of this process are the discontinuous nature of this procedure, pollution of the environment with aerosols, and the fact that microdrops remain on the wall of the cavity, and can no longer be removed from the wall even by increasing the amount and speed of air. This residual moisture must be reduced to a relative atmospheric humidity of $<10\%$ using drying agents, for example silica gel, in the sealed microtiter plate, in order to guarantee the storage stability of the coating. Thus, in the related art, microtiter plate drying requires a two-step process.

SUMMARY OF THE INVENTION

The invention provides benefits over the related art by shortening the drying process to a single step while at the same time ensuring that sufficient drying occurs. The invention achieves these objects by a process which comprises lowering a cannula having an internal diameter of 0.5 to 3 mm into the cavity at a lowering speed of 0.5 to 20 mm/second, the cavity being emptied via the cannula at a suction capacity of 50 to 2500 1/hour.

It can be expedient to stop the cannula 0.05 to 3 mm above the cavity base.

The advantages of the invention are essentially that the wash liquid can be removed in one step and no residual liquid remains in the cavities so that the relative atmospheric humidity of $<10\%$ after the microtiter plate has been sealed is achieved after a short time.

BRIEF DESCRIPTION OF THE DRAWINGS

The FIGURE is a graph comparing, for both the invention and the related art, the decrease in the relative atmospheric humidity in the packaging of a microtiter plate as a function of time.

DESCRIPTION OF THE PREFERRED EMBODIMENTS

The invention provides a one step process for drying coated microtiter plates, employing a cannula of the type that is conventionally used in connection with microtiter plates.

According to the invention, a cannula with an internal diameter of 0.5 to 3 mm, is lowered into the cavity of a microtiter plate at a lowering speed of 0.5 to 20 mm/second. As the cannula is lowered, it empties the cavity with a suction capacity of 50 to 2500 1/hr.

It is preferred that the cannula is only lowered to within between 0.05 and 3 mm of the base of the cavity.

Using the above-described one-step process, microtiter plates can be dried so that a relative atmospheric humidity of less than 10% may be achieved within a short time after the microtiter plates are sealed in their packaging.

The effectiveness of the invention is illustrated in the FIGURE. The method of the invention has been tested using a coated microtiter plate and a cannula having an internal diameter of 1.2 mm, which was lowered at a speed of 4.2 mm/second into a cavity filled with wash liquid. The cavity was emptied via the cannula at a suction capacity of 400 1/hour, and the relative packaging air humidity over time was measured and is recorded as curve 2 in the FIGURE. A similar blank experiment was conducted using a non-treated, non-coated microtiter plate. The results of this test are recorded as curve 1 in the FIGURE. Finally, the experiment was repeated using a coated microtiter plate and the related art drying method described earlier. Specifically, after washing, the plate was dried for 5 seconds in a second step using a turbo dryer from Sandy Spring Inc. As is evident from the FIGURE, the one step method of the present invention resulted in faster drying than the multiple step method of the related art.

We claim:

1. A microtiter plate drying process, comprising the steps of:

orienting a cannula above a cavity of a microtiter plate for removing moisture from the cavity, the cannula having an internal diameter in the range of 0.5 and 3 mm;

applying a suction force through the cannula, the suction force for providing the cannula with a suction capacity in the range of 50 to 2500 1/hr;

lowering the cannula into the cavity; and controlling a lowering speed of the cannula to lower the cannula into the cavity at a rate in the range of 0.5 and 20 mm/second.

2. The process as set forth in claim 1 wherein the cannula is lowered to a position in the range of 0.05 to 3 mm above a base of the cavity.

* * * * *